US007174115B2

(12) United States Patent
Ahn

(10) Patent No.: US 7,174,115 B2
(45) Date of Patent: Feb. 6, 2007

(54) ELECTROPHOTOGRAPHIC IMAGE FORMING APPARATUS

(75) Inventor: Byung-Sun Ahn, Suwon-si (KR)

(73) Assignee: Samsung Electronics, Co., Ltd., Suwon-si (KR)

( * ) Notice: Subject to any disclaimer, the term of this patent is extended or adjusted under 35 U.S.C. 154(b) by 0 days.

(21) Appl. No.: 11/033,748

(22) Filed: Jan. 13, 2005

(65) Prior Publication Data

US 2005/0185983 A1 Aug. 25, 2005

(30) Foreign Application Priority Data

Feb. 19, 2004 (KR) ..... 10-2004-0011004

(51) Int. Cl.
*G03G 15/00* (2006.01)

(52) U.S. Cl. ..... 399/110; 399/119; 399/120

(58) Field of Classification Search ..... 399/122, 399/119, 110

See application file for complete search history.

(56) References Cited

U.S. PATENT DOCUMENTS 5,707,167 A * 1/1998 Battocchio ..... 403/109.1
5,708,926 A * 1/1998 Sagara et al. ..... 399/122
6,681,090 B2 * 1/2004 Cornelius ..... 399/122

FOREIGN PATENT DOCUMENTS

| | | |
|---|---|---|
| JP | 06-083233 | 3/1994 |
| JP | 2000-015457 | 1/2000 |
| JP | 2000-029346 | 1/2000 |
| JP | 2000-214718 | 8/2000 |
| JP | 2002-156862 | 5/2002 |
| KR | U1999-0041811 | 12/1999 |

* cited by examiner

*Primary Examiner*—David M. Gray
*Assistant Examiner*—Joseph S. Wong
(74) *Attorney, Agent, or Firm*—Roylance, Abrams, Berdo & Goodman, L.L.P.

(57) ABSTRACT

An electrophotographic image forming apparatus prevents deformation of a pressing roller and to improves printing quality. The electrophotographic image forming apparatus includes a case and a developing unit removably installed in the case. The developing unit includes a housing and toner contained in the housing. A fixing unit fixes a toner image formed by transferring toner to paper received from the developing unit. The fixing unit includes a heating device that heats the paper on which the toner image is formed and a pressing roller that presses the toner image on the paper. A lever is pivotally fixed between the developing unit and the fixing unit. A first end portion of the lever supports the developing unit and a second end portion presses the pressing roller toward the heating device when the developing unit is installed in the case.

19 Claims, 6 Drawing Sheets

ELECTROPHOTOGRAPHIC IMAGE FORMING APPARATUS

BACKGROUND OF THE INVENTION

This application claims the benefit under 35 U.S.C. § 119(a) of Korean Patent Application No. 2004-11004, filed on Feb. 19, 2004, in the Korean Intellectual Property Office, the entire disclosure of which is expressly incorporated herein by reference.

FIELD OF THE INVENTION

The present invention relates to an electrophotographic image forming apparatus. More particularly, the present invention relates to an electrophotographic image forming apparatus having an improved configuration to prevent deformation of a pressing roller and to improve printing quality.

DESCRIPTION OF THE RELATED ART

Generally, an electrophotographic image forming apparatus, such as a laser printer and a digital copier, forms an electrostatic latent image by scanning light on a photosensitive medium charged to a predetermined electric potential, developing the electrostatic latent image with toner having a predetermined color to a visible image, and transferring and fixing the visible image on a sheet of paper to print the image. The electrophotographic image forming apparatus includes a fixing unit to fix a toner image on a sheet of paper by applying heat and pressure to the sheet of paper on which a predetermined toner image is formed by transferring toner.

FIG. 1 is a cross-sectional view illustrating a fixing unit used in a conventional electrophotographic image forming apparatus. Referring to FIG. 1, a conventional fixing unit 10 includes a heating roller 11 and a pressing roller 15 facing the heating roller 11. An image is printed on printing paper P passing therebetween.

The heating roller 11 includes a heater 12 in the center of the heating roller 11. The heater 12 is typically a halogen lamp. A coating layer 13, typically formed of Teflon, is formed on the surface of the heating roller 11. The heater 12 generates heat in the heating roller 11, and the outer surface of the heating roller 11 is heated by radiant heat transmitted from the heater 12.

The pressing roller 15 includes a flexible layer 16, typically made of silicon, on an outer portion. The pressing roller 15 is pressed elastically, and accordingly, the silicon layer 16 is pressed by the heating roller 11 to form a nip N. When the printing paper P passes through the nip N between the heating roller 11 and the pressing roller 15, a toner image T spread on the printing paper P in a powder state is fixed on the printing paper by heat and pressure.

The pressing roller 15 of the fixing unit 10 is continually pressed by the heating roller 11 on one side. The pressing roller 15 is separated from the heating roller 11 to remove jammed paper or to repair the fixing unit 10. Accordingly, when the fixing unit 10 is not used for a very long time, the pressing roller 15 may become deformed and can improperly fix an image in a subsequent printing process.

The nip N continues to rotate even when a paper jam occurs. Accordingly, removing the jammed paper caught between the heating roller 11 and the pressing roller 15 is often difficult. In addition, since a slip occurs between the heating roller 11 and the pressing roller 15 and the surfaces of the heating roller 11 and the pressing roller 15 have some toner powder not yet fixed on the printing paper P, forcibly removing jammed paper can reduce print quality of the next print process.

Accordingly, a need exists for an electrophotographic image forming apparatus that prevents deformation of a pressing roller and improves printing quality.

SUMMARY OF THE INVENTION

The present invention provides an electrophotographic image forming apparatus in which a developing unit and a fixing unit are connected such that a nip is formed in the fixing unit only when the developing unit is mounted in a housing.

According to an aspect of the present invention, there is provided an electrophotographic image forming apparatus including a case and a developing unit removably installed in the case. The developing unit includes a housing and toner contained in the housing. A fixing unit fixes a toner image formed by transferring toner to a paper received from the developing unit. The fixing unit includes a heating device to heat the paper on which the toner image is formed and a pressing roller pressing the toner image on the paper. A lever fixed between the developing unit and the fixing unit in the case is adapted to pivot, and includes a first end portion supporting the developing unit and a second end portion pressing the pressing roller toward the heating device when the developing unit is installed in the case.

The heat device may be a heating roller including a central heating element.

The apparatus may further include a stopper to control a rotation angle of the lever.

A pressing roller shaft may be connected to the second end portion of the lever to pivot with the lever.

The apparatus may further include a first spring to elastically bias a first end portion of the lever toward the developing unit.

The apparatus further includes a second spring disposed between the second end portion of the lever and the pressing roller shaft.

A distance between a lever pivot and the first end portion may not be shorter than a distance between the lever pivot and the second end portion.

The developing unit may include a photosensitive drum on which an electrostatic latent image is formed, and a developing roller supplying toner to the electrostatic latent image in order to form a toner image. The case may be equipped with a guide frame that guides the developing unit to a fixed position in the case and includes a first supporter supporting the photosensitive drum shaft and a second supporter supporting the developing roller shaft by contacting a peripheral surface of the developing roller shaft. The housing of the developing unit, in which one end portion is contacted to and supported by the first end portion of the lever, may include a slant surface adjacent to the contact position. When the developing unit is pivoted on the photosensitive drum shaft such that the developing roller shaft is parted from the second supporter of the guide frame, the slant surface may be contacted to and pressed by the first end portion of the lever by pivoting of the housing such that the photosensitive drum shaft is parted from the first supporter.

When the developing unit is mounted in the case for printing images, a first distance between a contact position of the housing, in which the housing is contacted to the first end portion of the lever, and a starting position of the housing slant surface, may be not greater than a second distance between a contact position of the second supporter of the guide frame, in which the second supporter of the guide frame contacting and supporting the developing roller shaft, and a start position of the slanting guide portion.

The guide frame may be equipped with a slant guide portion bias extending downwardly from the second supporter. When the photosensitive drum shaft is separated from the first supporter and the developing roller shaft is parted from the second supporter, the developing unit is guided to move downwardly by its own weight.

The first end portion of the lever may be equipped with an idle roller in order to decrease friction between the first end portion of the lever and the developing unit.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals depict like features and structures.

DETAILED DESCRIPTION OF EXAMPLARY EMBODIMENTS

Figure 1:
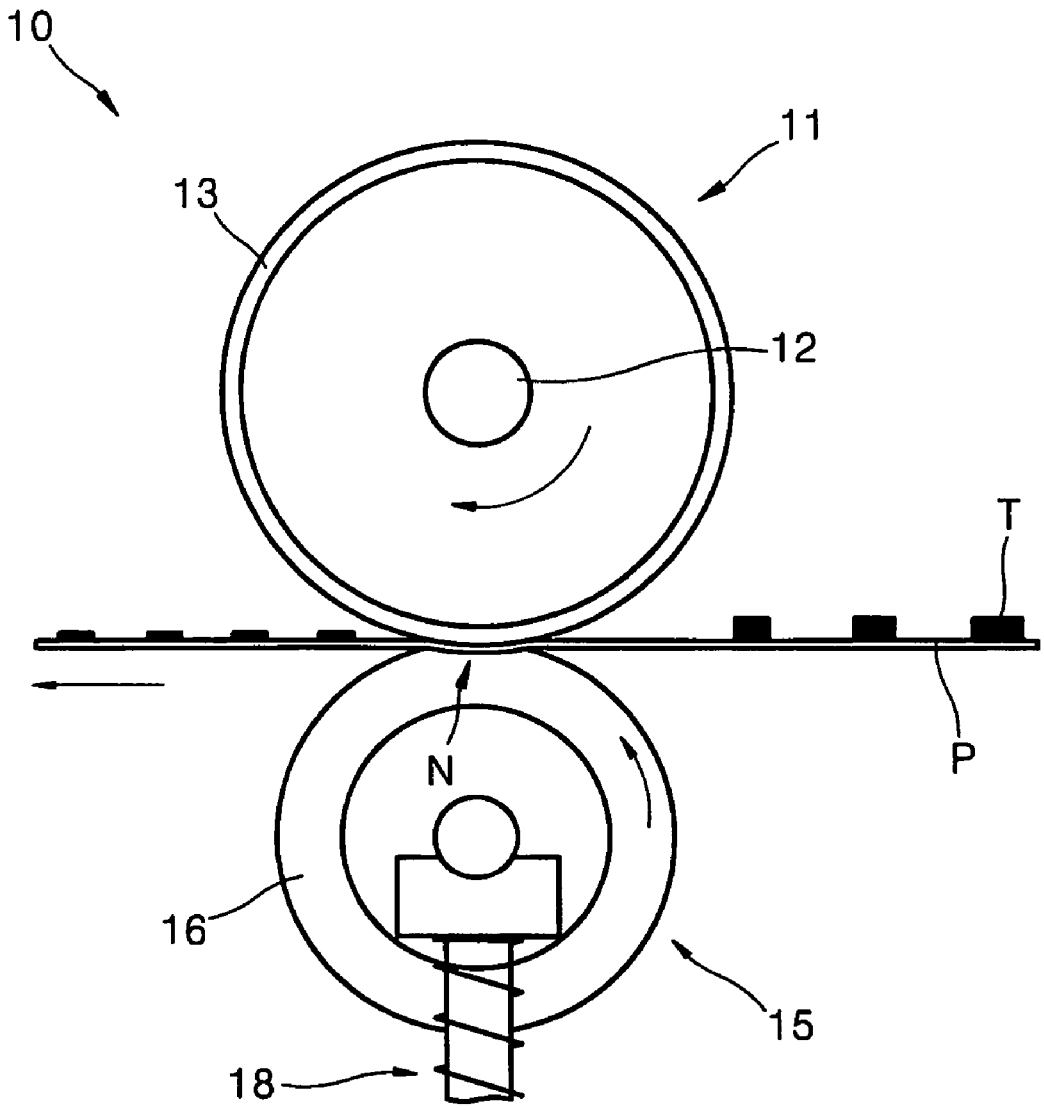
FIG. 1 (PRIOR ART)
FIG. 1 is a cross-sectional view of a fixing unit of a conventional electrophotographic image forming apparatus.
Figure 2:
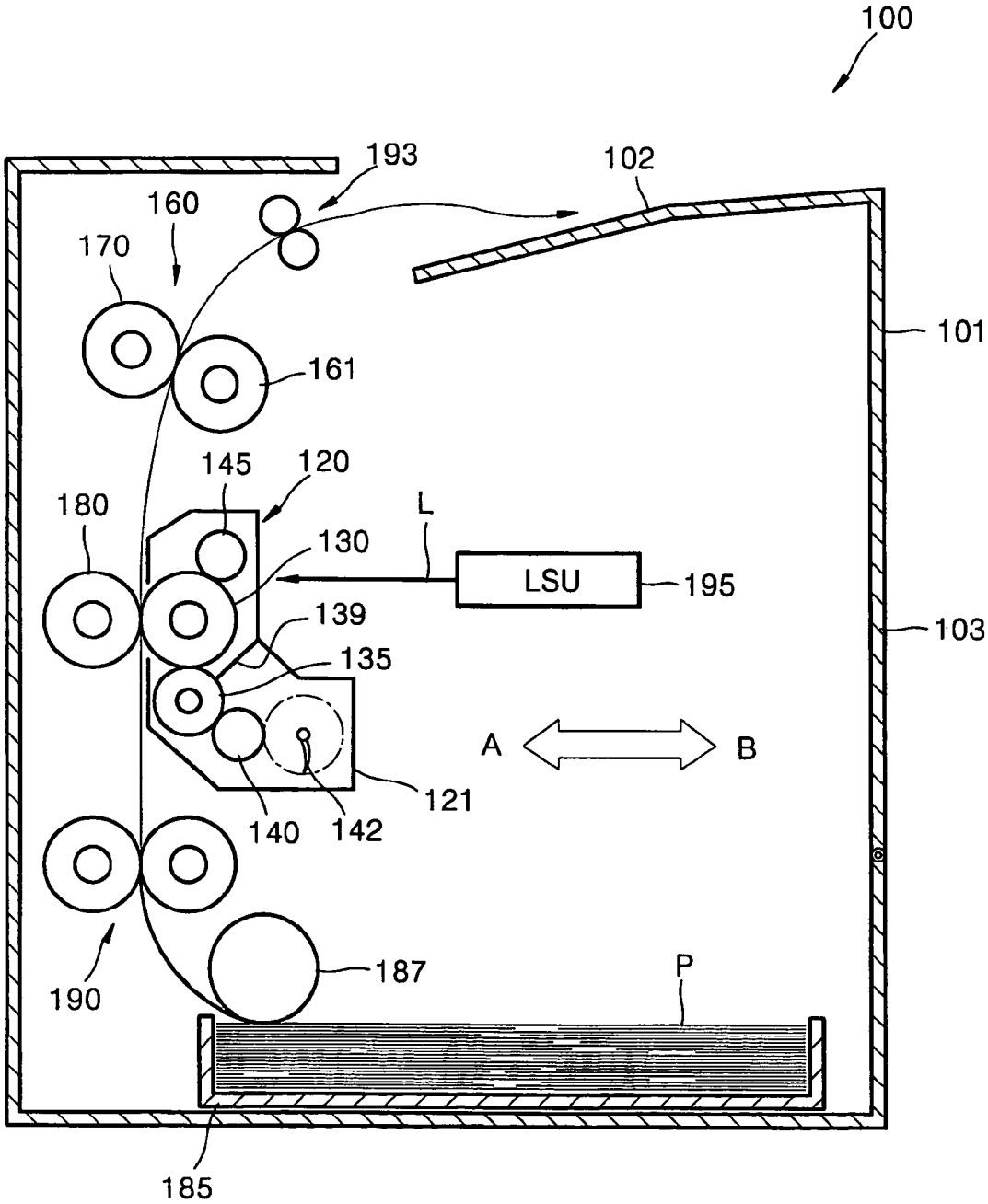
FIG. 2 illustrates a structure of an electrophotographic image forming apparatus according to an embodiment of the present invention.

Referring to FIG. 2, an electrophotographic image forming apparatus 100 is a C-path type image forming apparatus in which paper P is transported, printed, and discharged from bottom to top along a substantially C-shaped path. The apparatus 100 includes a case 101, a developing unit 120 adapted to be attached to and detached from the case 101, a fixing unit 160, a transfer roller 180, paper feeding cassette 185 in which sheets of paper P are loaded, and a light scanning unit 195.

The developing unit 120 includes a housing 121, a photosensitive drum 130 on which a electrostatic latent image is formed by light emission, a charge roller 145 for charging the photosensitive drum 130, a developing roller 135 for forming a toner image by supplying toner to the electrostatic latent image formed on the photosensitive drum 130, a regulation blade 139 regulating the thickness of toner attached on the surface of the developing roller 135, and a supply roller 140 supplying toner to the developing roller 135. Also, a developer container containing toner is provided in the housing 120, and an agitator 142 for agitating the toner is installed in the developer container. The developing unit 120 is formed as a cartridge type. When the toner in the cartridge is exhausted, the cartridge is replaced with a new cartridge.

The transfer roller 180 is installed to contact the photosensitive drum 130 and to press the paper P onto the photosensitive drum 130 in order to transfer the toner image formed on the photosensitive drum 130 to the paper P passing between the transfer roller 180 and the photosensitive drum 130.

The fixing unit 160 includes a heating roller 161 and a pressing roller 170 facing each other. The fixing unit 160 fixes the toner image on the paper P by heat and pressure when the paper P on which the toner image is transferred passes between the heating roller 161 and pressing roller 170.

Also, the electrophotographic image forming apparatus 100 includes a pick-up roller 187 that picksup the sheets of paper loaded in the paper feeding cassette 185 one by one. A paper feeding roller 190 transports the picked-up paper P and registers the paper P on which an image will be printed. A paper discharging roller 193 discharges the paper P on which an image is printed to a paper discharging rack 102.

The operation of the electrophotographic image forming apparatus 100 is discussed in the following paragraphs. The photosensitive drum 130 is charged to a predetermined electric potential via the charge roller 145. An electrostatic latent image corresponding to an image to be printed is formed on the photosensitive drum 130 via a light beam L emitted from the light scanning unit 195. Toner in the housing 121 is supplied to the photosensitive drum 130 on which the electrostatic latent image is formed via the supply roller 140 and the developing roller 135, thereby forming a toner image on the photosensitive drum 130. The paper P loaded in the paper feeding cassette 185 is picked-up by the pick-up roller 187, fed by the paper feeding roller 190, and passes between the photosensitive drum 130 and the transfer roller 180. In this case, the toner image formed on the photosensitive drum 130 is transferred to the surface of the paper P facing the photosensitive drum 130. The paper P on which the toner image is transferred passes between the heating roller 161 and the pressing roller 170 of the fixing unit 160 to fix the image on the paper P by heat and pressure, is transported by the paper discharging roller 193, and is loaded on the paper discharging rack 102.

Figure 3:
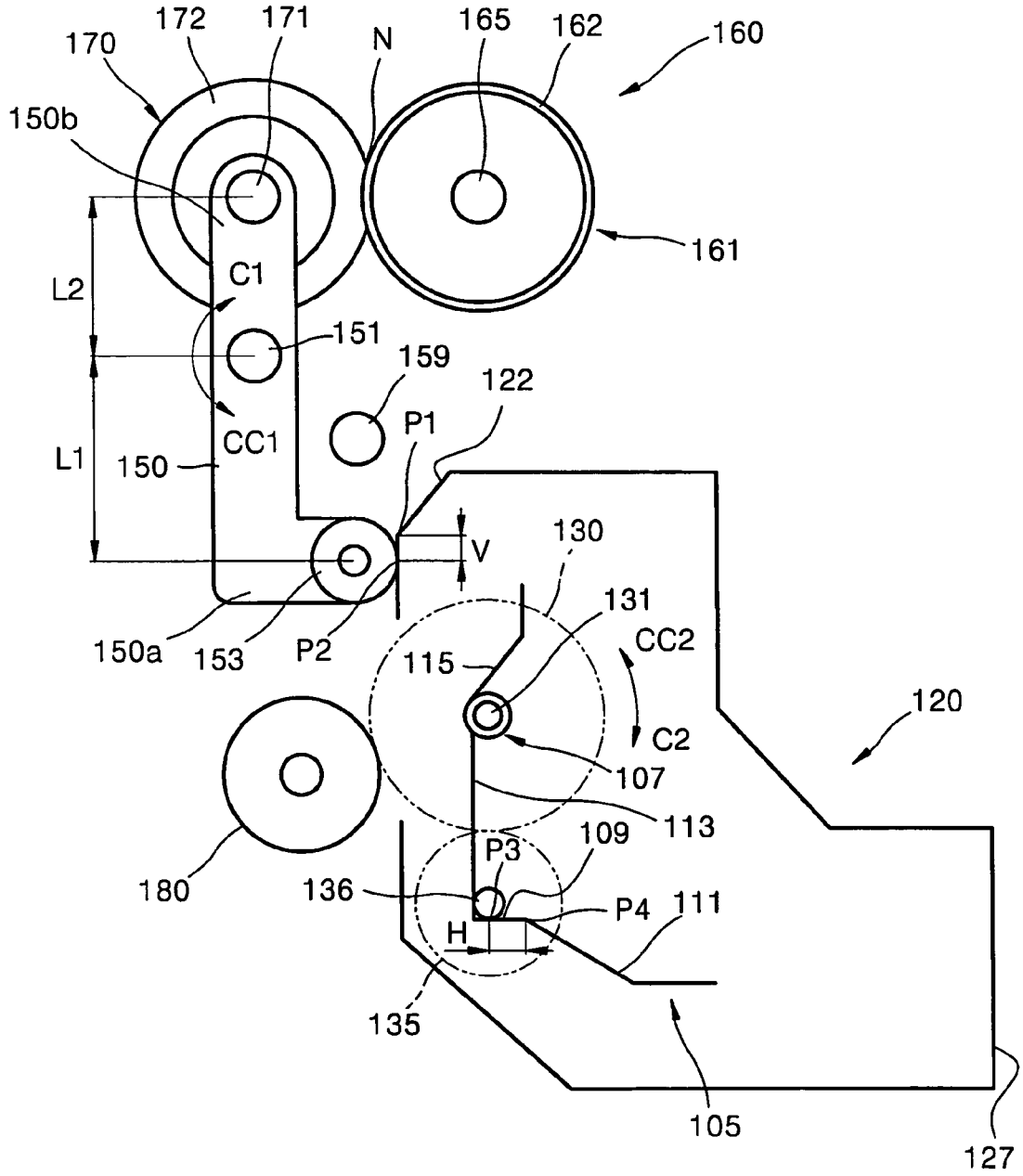
FIG. 3 illustrates a portion of the electrophotographic image forming apparatus of FIG. 2 when a developing unit is mounted on a mount location inside a case.
Figure 4:
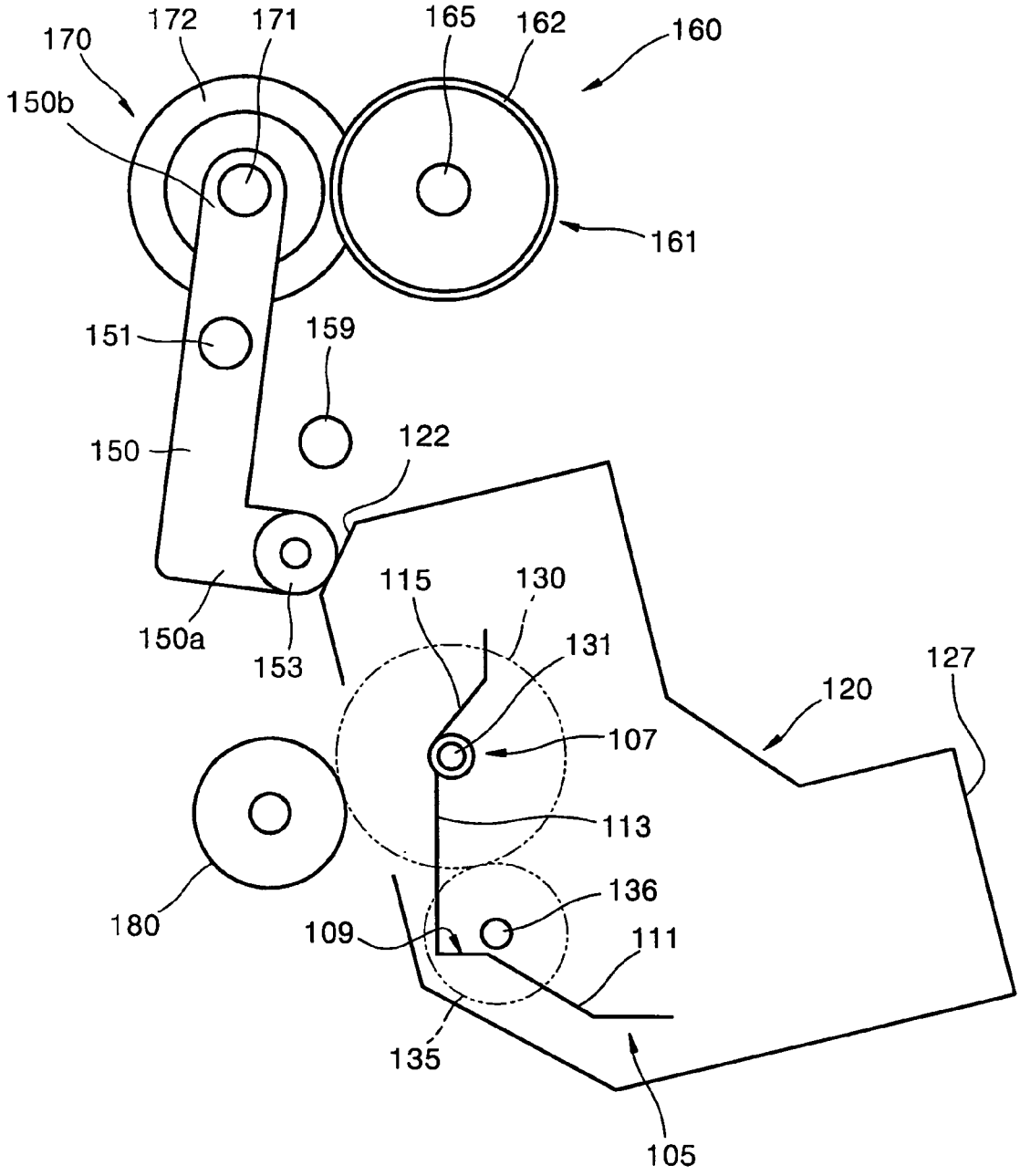
FIG. 4 illustrates a portion of the electrophotographic image forming apparatus of FIG. 2 when the developing unit is slightly pivoted.

Referring to FIGS. 3 and 4, the heating roller 161 includes a heating element centered on the heating roller 161, and is fixed inside the case 101. The heating element 165 may include a halogen lamp or an electric resistance material, such as nickel chrome or ferrous (iron) chrome. The circumferential surface of the heating roller 161 is heated by radiant heat transmitted from the heating element 165. A passivation layer 162 coated with Teflon is formed on the circumferential surface of the heating roller 161.

The pressing roller 170 includes an elastic layer 172 composed of silicone. Accordingly, when the pressing roller 170 is pressed on to the heating roller 161, the elastic layer 172 is pressed to form a nip N. The paper P on which the toner image is formed passes through the nip N of the fixing unit 160, and the toner image is fused by heat transmitted from the heating roller 161 and is pressed on the paper P by pressure of the pressing roller 170.

The electrophotographic image forming apparatus 100 includes a lever 150 connecting the fixing unit 160 to the developing unit 120. The lever 150 is fixed inside of the case 101 and is adapted to rotate between the developing unit 120 and the fixing unit 160. A first end portion 150*a* of the lever 150 contacts and supports the housing 121 of the developing unit 120 when the developing unit 120 is installed in the case 101 for printing an image. A second end portion 150*b* of the lever 150 is opposite the first end portion 150*a*. The second end portion 150*b* urges and presses the pressing roller 170 against the heating roller 161 by a reaction force applied from the housing 121 to the first end portion 150*a* contacted to the housing 121, thereby forming the nip N. A pressing roller shaft 171 is connected to the second end portion 150*b* to be pivotable therewith. Thus, as clearly shown in FIGS. 3 and 4, when the developing unit 120 is removed from the case 101, the lever 150 pivots in a clockwise direction C1 such that the first end portion 150*a* moves in a leftwardly and upwardly direction and the second end portion 150*b* moves in a substantially rightwardly and downwardly direction. Upon insertion of the developing unit 120 into the case 101, the lever 150 pivots in a counterclockwise direction CC1 such that the first end portion 150*a* moves substantially rightwardly and downwardly and the second end portion 150*b* moves substantially leftwardly and upwardly. Thus, upon insertion and removal of the developing unit, the first and second end portions 150*a* and 150*b* of the lever 150 move in substantially opposite directions. When the developing unit 120 is removed, the pressed elastic layer 172 of the pressing roller 170 is decompressed and the nip N is removed, and the lever 150 is pivoted in counterclockwise direction CC1. The combination of the lever 150 and the pressing roller 170 moves the center of gravity toward the pressing roller 170 from a pivot 151 of the lever 150. Therefore, the lever 150 is capable of being pivoted until the pressing roller 170 is under the pivot 150. In this case, when the developing unit 120 is mounted in the case 101 the first end portion 150*a* of the lever 150 may not contact the housing 121. Thus, a stopper 159 is provided for controlling a rotation angle of the lever 150.

Since the elastic layer 172 of the pressing roller 170 linearly expands and contracts in a restricted range, permanent deterioration of the elastic layer 172 or damage to the heating roller 161 and the lever 150 may be caused by extreme right and left movement of the pressing roller 170. A length between the pivot 151 and the first end portion 150*a* is L1 (a first distance). A length between the pivot 151 and the second end portion 150*b* is L2 (a second distance). Preferably, the lever 150 is designed such that L1 is not shorter than L2 and the movement of the pressing roller 170 is not greater than movement of the developing unit 120.

A guide frame 105 guides the developing unit 120 to a location in which the photosensitive drum 130 and the transfer roller 180 contact each other. The guide frame 105 guides a photosensitive drum shaft 131 projecting out of the housing 121 and a developing roller shaft 136 to enter and exit the case 101 through a predetermined path. When the developing unit 120 is mounted in the case 101 to print images, a first supporter 107 supports the photosensitive drum shaft 131 and a second supporter 109 supports the developing roller shaft 136. The first supporter 107 includes a groove in which the photosensitive drum shaft 131 projecting out of the housing 121 is safely set and is placed such that the developing unit 120 can be pivoted on the photosensitive drum shaft 131 in a state in which the photosensitive drum shaft 131 is safely set in the groove. The second supporter 109 contacts the bottom of the circumferential surface of the developing roller shaft 136 projecting out of the housing 121. The left surface of the second supporter 109 controls pivoting or movement of the developing unit 120. The guide frame 105 also includes a slant guide portion 111 that extends and slants below from the second supporter 109. A photosensitive drum shaft guide portion 113 extends from the first supporter 107 to the second supporter 109. A photosensitive drum shaft stopper portion 115 extends and slants from the first supporter 107 in a direction opposite to the extension direction of the slant guide portion 111.

When the developing unit 120 is mounted in the case 101, referring to FIG. 3, the upper end portion of the housing 121 contacts and is supported by the first end portion 150*a* of the lever 150. A housing slant surface 122 is formed above the contact location. Referring to FIGS. 3 and 4, when the developing unit 120 is pivoted in a counterclockwise direction CC2 to extract the developing unit 120 out of the case 101, the housing slant surface 122 is pressed by the first end portion 150*a*, which pivots lever 150 in the clockwise direction C1 of FIG. 3. Since the first end portion 150*a* slides along the upper end portion of the housing 121 because of the pivoting motion of the developing unit 120, an idle roller 153 is provided at the first end portion 150*a* to decrease friction therebetween. In FIG. 3, "V" indicates a distance (a third distance) between a housing contact location P2 in which the housing 121 is contacted by the first end portion 150*a* and a location P1 at which the housing slant surface 122 starts. "H" indicates a distance (a fourth distance) between a second supporter contact location P3 at which the second supporter 109 of the guide frame 105 is contacted by and supports the developing roller shaft 136 and a location P4 at which the slant guide portion 111 starts. Preferably, the electrophotographic image forming apparatus 100 shown in FIG. 3 is designed such that V is not greater than H.

Preferably, to mount the developing unit 120 in the case 101, a right side 103 of the case is opened, as shown in FIG. 2. Then the developing unit 120 is pushed in a direction of an arrow A shown in FIG. 2 such that the housing slant surface 122 reaches the front of the progress direction. Then, the photosensitive drum shaft 131 is guided by the slant guide portion 111 of the guide frame 105 and the photosensitive drum shaft guide portion 113 and arrives safely at the first supporter 107 by the photosensitive drum shaft stopper portion 115. The developing roller shaft 136 is guided by the slant guide portion 111 to contact and be supported by the second supporter 107. During this installation, the developing unit 120 pivots in clockwise direction C2 and the photosensitive drum 130 is contacted to be in a position as shown in FIG. 3. In this position, the housing 121 presses the first end portion 150*a*, thereby pivoting lever 150 so that the pressing roller 170 is stuck to the heating roller 161 and the elastic layer 172 elastically contracts to form the nip N. In this case, the lever 150 presses the housing 121, but the developing roller shaft 136 is supported by the second supporter 109 and cannot move, thereby substantially preventing pivoting of the developing unit on the photosensitive drum shaft 131. Also, right and left tremors of the developing unit 120 are controlled even during an external impact to the electrophotographic image forming apparatus during image printing.

To extract the developing unit 120, a user pushes and lifts a handle of a lower end projection portion 127 of the housing 121. Then the developing unit 120 pivots on the photosensitive drum shaft 131, as shown in FIG. 4. The developing roller shaft 136 is separated from the second supporter 109, and the housing slant surface 122 is simultaneously pressed by the first end portion 153. The lever pivots in clockwise direction C1, thereby causing more of the elastic layer 172 to contact the heating roller 161. The counterclockwise rotation CC2 of the developing unit 120 causes an increased pressure on the housing slant surface 122 compared with a pressure on the housing 121 when the developing unit is not pivoting, as shown in FIG. 3. The photosensitive drum shaft 131 departs from the first supporter 107 due to the pressure on the housing slant surface 122. The developing roller shaft 136 falls along the slant guide portion 111 due to the weight of the developing unit 120. The photosensitive drum shaft 131 falls along the photosensitive drum shaft guide portion 113 to the second supporter 109. Since V is not greater than H when the developing roller shaft 136 is out of the second supporter 109 and positioned on the slant guide portion 111, the housing slant surface 122 is contacted and pressed by the first end portion 150*a*, thereby pushing and raising the lower end projection portion 127. Next, the user grips the handle of the lower end projection portion 127 and extracts the developing unit 120 in the direction of an arrow B, as shown in FIG. 2, out of the case 101.

Figure 5:
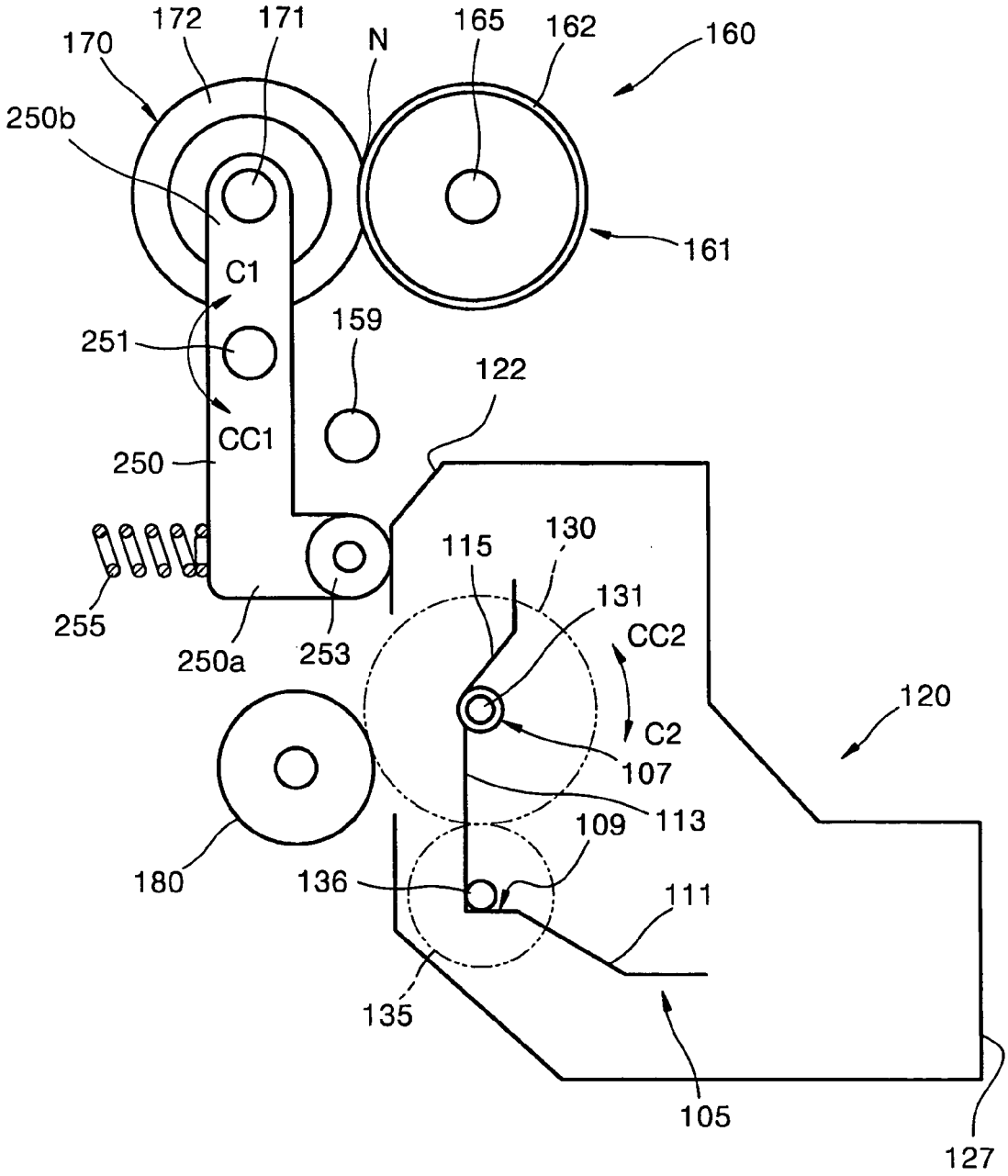
FIGS. 5 and 6 illustrate portions of the electrophotographic image forming apparatus according to other embodiments of the present invention, when the developing unit is mounted on the mount location inside the case.
Figure 6:
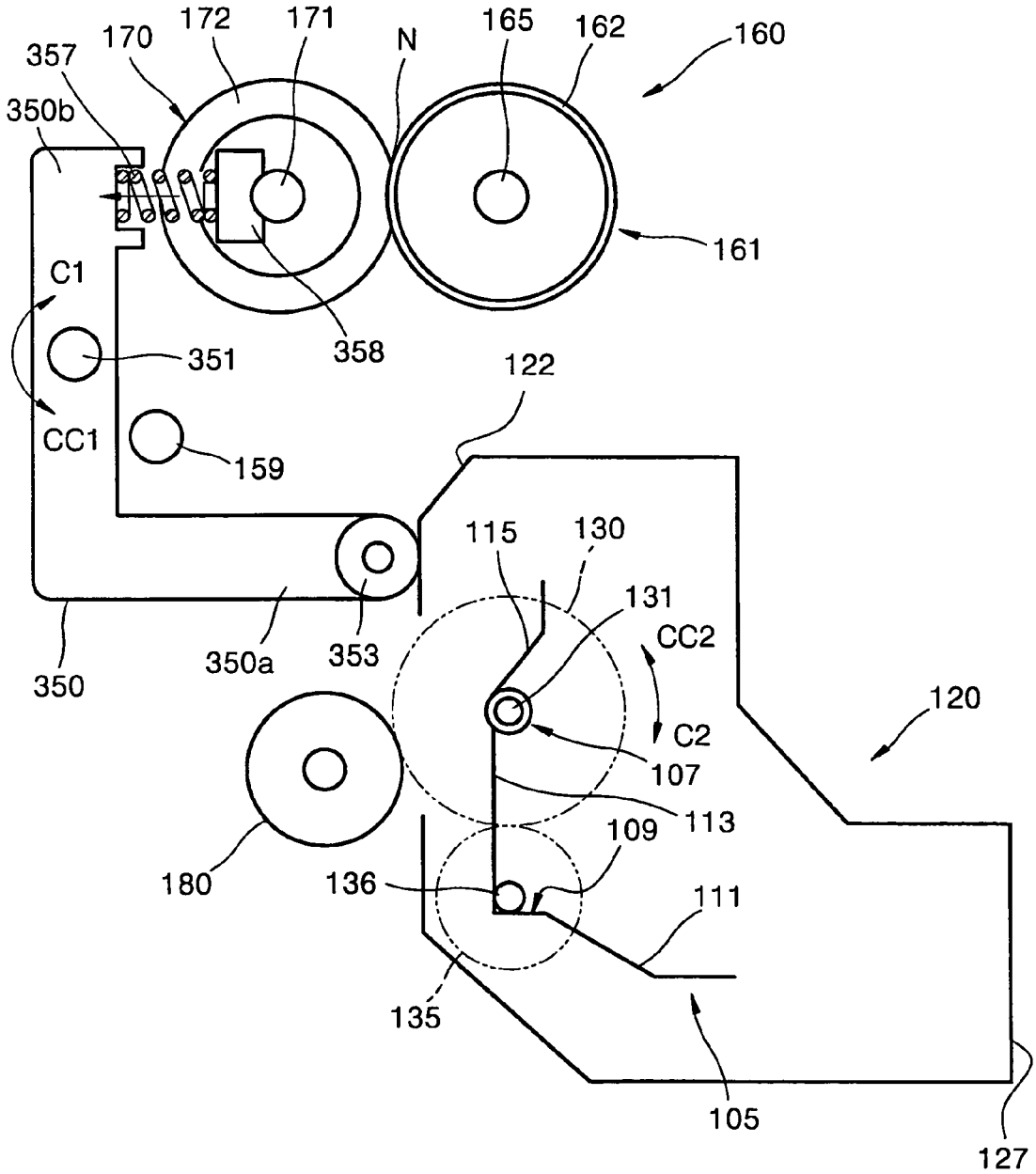

FIGS. 5 and 6 respectively illustrate electrophotographic image forming apparatuses according to other embodiments of the present invention. The electrophotographic image forming apparatuses of FIGS. 5 and 6 use the same reference numerals for similar elements shown in FIGS. 2 and 4.

In the electrophotographic image forming apparatus of FIG. 5, a lever 250 is pivotally fixed between the fixing unit 160 and the developing unit 120 on a pivot 251 in the case 101. When the developing unit 120 is fixed to print images in the case 101, the lever includes a first end portion 250*a* contacting and supporting the upper end of the housing 121 above the photosensitive drum shaft 131 and a second end portion 250*b* located opposite to the first end portion 250*a*. The second end portion 250*b* presses the pressing roller 170 toward the heating roller 161 due to a reaction force of the first end portion 250*a* pressed by the housing 121, and a nip N is formed. A pressing roller shaft 171 is connected at the second end portion 250*a* to pivot with the lever. An idle roller 253 is provided at the first end portion 250*a* to decrease friction with an upper end portion of the housing 121. A stopper 159 is provided to control rotation angle of the lever 25O. A first spring or first elastic member 255 is provided to elastically bias the first end portion 250*a* toward the developing unit 120. One end portion of the first spring 255 is connected to a predetermined frame of the case 101 and the other end portion of the first spring 255 is connected to the first end portion 250*a*.

When the housing 121 is pivoted in counterclockwise direction CC2 on the photosensitive drum shaft 131 to extract the developing unit 120 out of the case 101, the lever 250 is pressed by the upper end portion of the housing 121 and slightly pivots in clockwise direction C1. the clockwise rotation of the lever 250 increases pressure on the elastic layer 172 of the pressing roller 170, as well as contracting the first spring 255. The housing slant surface 122 then contacts the first end portion 250*a* of the lever 250. Accordingly, since the first spring 255 increases the pressure applied by the first end portion 250*a* of the lever 250 against the housing slant surface 122, the photosensitive drum shaft 131 is completely separated from the first supporter 107 of the guide frame 105.

In the electrophotographic image forming apparatus of FIG. 6, a lever 350 is pivotally fixed between the fixing unit 160 and the developing unit 120 on a lever pivot 351. When the developing unit 120 is installed in the case 101 to print images, the lever 350 includes a first end portion 350*a* contacting and supporting an upper end portion of the housing 121 above the photosensitive drum shaft 131 and a second end portion 350*a* located opposite to the first end portion 350*a*. A second spring or second elastic member 357 is disposed between the second end portion 350*b* of the lever 350 and the pressing roller shaft 171 to absorb shocks and other jarring motions associated with the electrophotographic image forming apparatus. One end portion of the second spring 357 is connected to the second end portion 350*b* of the lever 350. The other end portion of the second spring 357 is connected to a bracket 358 supporting the pressing roller shaft 171, so that the pressing roller 170 pivots with the lever 350. Accordingly, the second end portion 350*b* presses the pressing roller 170 toward the heating roller 161 to form the nip N. The second spring 357 absorbs shocks to the second end portion 350*b* of the lever 350 and the pressing roller 170 due to reaction forces of the housing 121 applied to the first end portion 350*a*. An idle roller 353 is installed at the first end portion 350*a* to decrease friction between the lever 350 and an upper end portion of the housing 121. A stopper 159 may be provided to control a rotation angle of the lever 250 in the case 101.

When the developing unit 120 is pivoted on the photosensitive drum shaft 131 in counterclockwise direction CC2 to extract the developing unit from the case 101, the lever 350 is pushed by the upper end portion of the housing 121, which causes the lever 350 to pivot slightly in clockwise direction C1 and the housing slant surface 122 to contact the first end portion 350*a*. The second spring 357 is contracted, but less pressure is applied to the elastic layer 172 of the pressing roller 170 due to the shock-absorbing abilities of the second spring 357. Accordingly, damage or deterioration of the elastic layer 172 caused by excessive pressure is decreased, and a location of the lever pivot 351 is easily determined. Since the first end portion 350*a* of the lever 350 more powerfully presses against the housing slant surface 122 because of the contracted second spring 357, the photosensitive drum shaft 131 is separated from the first supporter 107 of the guide frame 105.

Hereinafter, advantages of the electrophotographic image forming apparatus according to the present invention are described.

First, since a nip is formed at a fixing unit only when a developing unit is installed in a case, permanent deformation of a pressing roller is substantially prevented. Accordingly, lowering of printing quality caused by the deformation of the pressing roller is prevented. Furthermore, when a paper jam occurs, the jammed paper may be easily removed.

Second, since a pressing roller and the developing unit are connected by a lever, a tremor of the developing unit caused by an unexpected external shock may be prevented Lowering of printing quality due to such an external shock, such as a jitter of a printed image, is substantially eliminated.

Third, by including a housing slant surface and a guide frame in the electrophotographic image forming apparatus, the developing unit may be easily extracted out of the case by rotating a developing unit housing with light force.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, although the present invention has been described with reference to a C-path type electrophotographic image forming apparatus, an S-path type electrophotographic image forming apparatus may be used. Also, a plate type heating device instead of a heating roller may be employed.

What is claimed is:

1. An electrophotographic image forming apparatus, comprising:

a case;

a developing unit removably installed in the case and having a housing and toner contained in the housing;

a fixing unit for fixing a toner image formed by transferring toner to a paper received from the developing unit, the fixing unit including a heating device to heat the paper on which the toner image is formed and a pressing roller to press the toner image on the paper; and a lever pivotally fixed between the developing unit and the fixing unit, a first end portion of the lever contacting the developing unit and a second end portion of the lever being connected to a shaft of the pressing roller to urge the pressing roller toward the heating device when the developing unit is installed in the case, the first end portion of the lever being moved in a direction substantially opposite to a direction in which the second end portion of the lever moves when the developing unit is installed.

2. The apparatus of claim 1, wherein the heating device is a heating roller including a central heating element.

3. The apparatus of claim 1, wherein a stopper secured in the case controls a rotation angle of the lever.

4. The apparatus of claim 1, wherein a spring connected to the lever to elastically bias the first end portion of the lever toward the developing unit.

5. The apparatus of claim 1, wherein a spring is disposed between the second end portion of the lever and the pressing roller shaft.

6. The apparatus of claim 1, wherein a first distance between a lever pivot and the first end portion is not shorter than a second distance between the lever pivot and the second end portion.

7. The apparatus of claim 1, wherein:

the developing unit includes a photosensitive drum on which an electrostatic latent image is formed, and a developing roller supplying toner to the electrostatic latent image in order to form the toner image;

the case is equipped with a guide frame to guide the developing unit to a fixed position in the case and including a first supporter supporting the photosensitive drum shaft and a second supporter supporting the developing roller shaft by contacting a peripheral surface of the developing roller shaft;

the housing of the developing unit including a slant surface proximal to a contact position at which the first end portion of the lever contact the developing unit housing; and when the developing unit is pivoted on the photosensitive drum shaft such that the developing roller shaft is separated from the second supporter of the guide frame, the first end portion of the lever presses against the slant surface and pivots the housing such that the photosensitive drum shaft is separated from the first supporter.

8. The apparatus of claim 7, wherein a third distance between the contact position of the first end portion of the lever and the housing and a starting position of the housing slant surface is not greater than a fourth distance between a contact position of the second supporter of the guide frame and the developing roller shaft and a start position of the slanting guide portion when the developing unit is mounted in the case to print images.

9. The apparatus of claim 7, wherein the guide frame is equipped with a slant guide portion bias extending downward from the second supporter; and when the photosensitive drum shaft is separated from the first supporter and the developing roller shaft is separated from the second supporter, movement of the developing unit is guided downwardly along the slant guide portion bias by its own weight.

10. The apparatus of claim 1, wherein an idle roller is disposed at the first end portion of the lever to decrease friction between the first end portion of the lever and the developing unit.

11. An electrophotographic image forming apparatus, comprising:

a developing unit having a housing;

a fixing unit having a heating roller and a pressing roller to fix an image on a paper;

a pivotally fixed lever having a first end portion contacting the developing unit housing and a second end portion connected to the pressing roller of the fixing unit, the force of the developing unit housing on the lever pivots the lever to urge the pressing roller against the heating roller such that the first end portion of the lever moves in a direction substantially opposite to a direction in which the second end portion of the lever moves when the developing unit is installed.

12. The apparatus of claim 11, wherein an elastic member is connected to the lever to urge the first end portion of the lever toward the developing unit housing.

13. The apparatus of claim 11, wherein an elastic member is connected at a first end to the lever and at a second end to the pressing roller to absorb shocks to prevent poor image forming on the paper.

14. The apparatus of claim 13, wherein the second end of the elastic member is connected to the second end portion of the lever.

15. The apparatus of claim 11, wherein an idle roller is connected to the first end of the lever to reduce friction between the lever and the developing unit housing.

16. The apparatus of claim 11, wherein a guide frame guides the developing unit during installation and removal thereof.

17. The apparatus of claim 11, wherein a stopper limits rotation of the lever.

18. The apparatus of claim 11, wherein a first distance from a pivot point of the lever to the first end portion is at least as long as a second distance from the pivot point of the lever to the second end portion.

19. The apparatus of claim 11, wherein a heating element is substantially disposed within the heating roller.

* * * * *